United States Patent [19]

Maudlin

[11] 4,041,727

[45] Aug. 16, 1977

[54] EVAPORATOR ASSEMBLY

[75] Inventor: Eugene Wendell Maudlin, York, Pa.

[73] Assignee: Borg-Warner Corporation, Chicago, Ill.

[21] Appl. No.: 609,280

[22] Filed: Sept. 2, 1975

[51] Int. Cl.[2] ..... F25D 21/14

[52] U.S. Cl. ..... 62/290; 165/181

[58] Field of Search ..... 62/285, 288, 289, 290, 62/291; 165/181

[56] References Cited

U.S. PATENT DOCUMENTS

| | | | |
|---|---|---|---|
| 2,089,367 | 8/1937 | Harbers | 62/290 |
| 2,136,222 | 11/1938 | Starr | 62/290 |
| 3,750,418 | 8/1973 | Maudlin | 62/290 |

*Primary Examiner*—Ronald C. Capossela
*Attorney, Agent, or Firm*—Thomas B. Hunter

[57] ABSTRACT

A finned coil type evaporator of the type adapted to be provided in an upward flowing air stream and including a plate fin construction having condensate director means to cause condensate to flow to collecting troughs extending underneath said fins. The upper portion of each fin also includes a saw tooth shaped edge to reduce the tendency of water condensate to be supported at the upper edge of each fin when the velocity of the air stream is sufficient to raise the droplets of water to the top of the coil.

1 Claim, 3 Drawing Figures

EVAPORATOR ASSEMBLY

BACKGROUND AND SUMMARY OF THE INVENTION

1. Field of the Invention:

This invention relates to finned evaporator coils for air conditioning apparatus which include means for frustrating the tendency of liquid condensate to collect at the top edges of the fins.

2. Description of the Prior Art:

This invention is an improvement over the evaporator coil assembly described in U.S. Pat. No. 3,750,418 issued to W. E. Maudlin on Aug. 7, 1973. The Maudlin patent includes means for directing condensate from the lower edge of the fins and causing it to be removed to narrow troughs underlying the saw tooth-like edge of such fins where it may be discharged to waste. The Maudlin invention has the advantage that the overall height of the evaporator coil assembly may be substantially reduced as compared to the conventional A-frame construction in which condensate merely drains down the two legs of the coil and is collected by a drain system.

Some difficulty has been experienced with the Maudlin evaporator coil assembly when used in an upflow air installation. Specifically, the water droplets sometimes tend to bridge the spaces between adjacent fins; and when the air flow is sufficient, the droplets are swept upwardly toward the top edge of the fins where they accumulate and increase the pressure drop across the coil.

Still another prior art reference showing condensate removal is E. F. Holyfield, U.S. Pat. No. 3,306,071 issued Feb. 28, 1967.

SUMMARY OF THE INVENTION

This invention is directed to means for substantially eliminating the accumulation of condensate at the top edge of an evaporator coil of the type shown in Maudlin U.S. Pat. No. 3,750,418. Water droplets build up on the sides of the tubes and may eventually bridge across between adjacent tubes. The air pressure forces the water upward to the top edge of the fins where it tends to collect and "sheet" across the entire assembly.

This phenomenon becomes a vicious circle because when it begins to sheet, the air side pressure drop becomes greater tending to bring up more water and increasing the forces holding it up. If the fin edge is perpendicular to airflow, there is no edge for it to follow to get out of that condition because the edge has an affinity for the water. In the present invention, a plurality of sloping edges are provided at the top of the fins, for example, by a saw tooth design. The water will still drive to that edge; but being at an angle, preferably about 60, it can't sheet and hold there because the air slides by it at an angle. Eventually it will form a large enough droplet so that it falls down between adjacent fins where it may be caught on the bottom edges and then drained to the troughs below the condensate directors.

In the region below the top bank of tubes, the water is doing the same thing — bridging across the tubes and being driven upwardly. At least a certain amount of this water will usually form into big enough droplets by the time they move across one tube row to make them fall down.

DESCRIPTION OF THE PREFERRED EMBODIMENT

Figure 1:
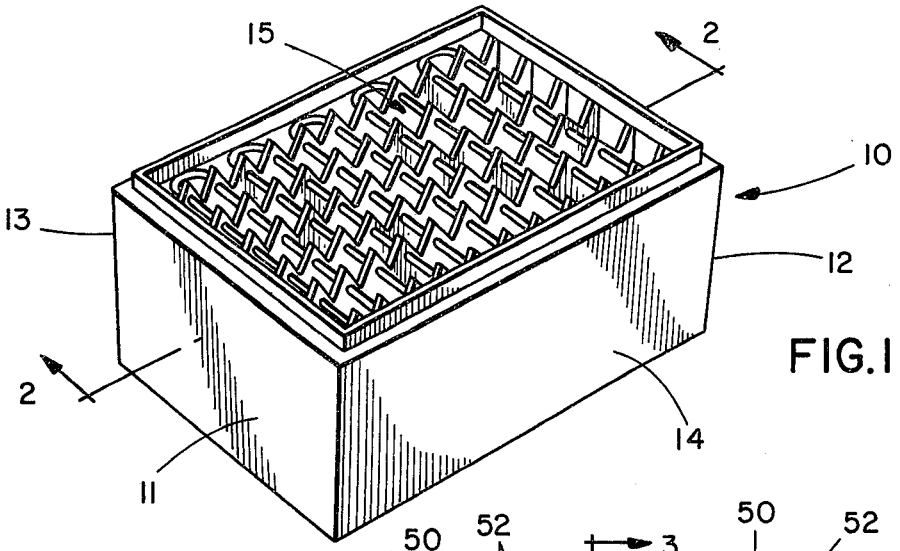
FIG. 1 is a perspective view of an air conditioning compartment having the improved evaporator coil assembly of the present invention.

Referring now to the drawing, the duct or plenum 10, which may form a portion of the warm air heating and air conditioning system, has side walls 11 and 12 and end walls 13 and 14. A finned evaporator coil structure 15, in the form of a bank or slab, is horizontally positioned in the plenum and extends substantially the entire length and width of the compartment. A blower (not shown) is positioned upstream or downstream of the coil and adapted to draw (or force) air through the coil in upward fashion as shown by the arrows in FIGS. 2 and 3. The coil is supported on the plenum side walls 11 and 12 by a plurality of spaced brackets 16, connected to the thin sheet metal plate-like fins 17 of the coil assembly, and by bolts 18 extending through the walls 11 and 12 and into threaded openings in brackets 16.

The evaporator structure 15 comprises a tube bent back and forth upon itself to provide a coil 19 acting as a refrigerant expansion chamber and absorbing heat from the air to thus provide cooling thereof. Associated with the coil are a plurality of the fins 17 mounted on the coil convolutions at right angles to the axes of the parallel coil portions and through which the coil passes. The evaporator structure 15 is horizontally mounted in the compartment 10 in the path of the air streams flowing vertically, as indicated by the arrows in FIGS. 2 and 3, to expose a maximum area to the air entering the lower end of the compartment, flowing through the evaporator structure, and discharging from the upper open end of the compartment.

Figure 2:
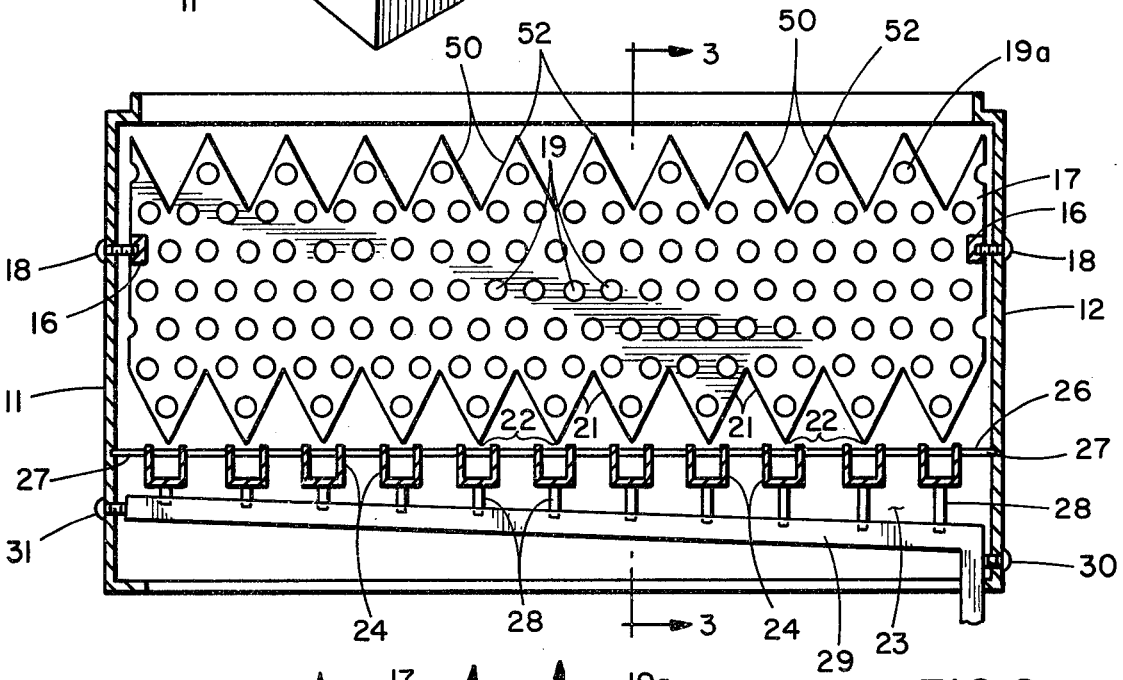
FIG. 2 is a sectional view taken along line 2—2 of FIG. 1 showing the fin and coil structure, and the edge configuration of the fins.
Figure 3:
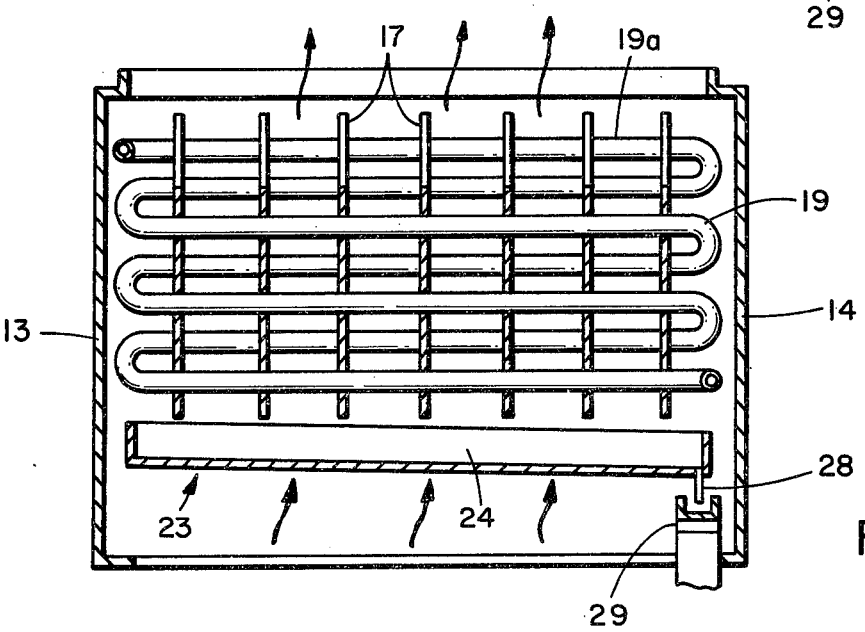
FIG. 3 is a sectional view taken along line 3—3 of FIG. 2.

As shown in FIG. 2, each fin 17 has a saw toothlike bottom edge providing a series of V-shaped portions 21 having both sides tapered angularly toward a point 22 at the lowermost extremity of the fin. This shape of the fins insures that moisture, formed by condensation of the surfaces of each fin, will be in the form of a thin continuous film of condensate on the fin and will flow, by gravity, to the lowermost discharge point 22 of the fin.

A condensate collector assembly 23 is disposed in the plenum 10, and relative to the evaporator structure 15, to cooperate with the coil structure 15 in a manner to insure that moisture, condensed on and flowing downwardly of the fins, is collected while providing minimum resistance and restriction to air flowing through the compartment and into the coil structure. More particularly, the collector assembly 23 comprises a plurality of U-shaped troughs 24 respectively disposed directly beneath the lowermost points of the fins, namely, tips 22 of the V-shaped portions 21 of the fins. The troughs 24 may be formed of thin metal or lightweight plastic and of such width as to be aligned with and underlie only the tips 22 so that maximum air flow through the collector assembly 23 is assured. The troughs are connected together by two spaced thin rods 26 extending through the side walls of the troughs and having their ends seated in pockets 27 in the side walls 11 and 12 of the compartment. Each trough 24 is angularly inclined to the end walls 13 and 14 of the plenum (FIG. 3) so that condensate moisture in the troughs will flow downwardly from wall 13 to 14 and, at its lower closed end near the wall 14, will enter spouts 28 and flow into a collector trough 29 inclined angularly from the side wall 11 to the side wall 12 of the plenum. In FIG. 2, the collector trough 29 is shown to be held in position by bolts 30 and 31 extending through the walls 11 and 12 and threaded into the trough ends to support the trough beneath the spouts 28 of the troughs 24.

As best shown in FIG. 2, the feature to which the present invention is directed is the shape of the upper edge of each fin 17. This upper edge was formed with upwardly extending V-shaped teeth 50 similar to the downwardly extending V-shaped elements 21. Each of the teeth 50 terminates in a sharp apex 52 which extends well above the level of the top row of heat exchange tubing 19*a*.

As indicated above, the purpose of the V-shaped elements 50 is to prevent the accumulation of liquid condensate at or adjacent the upper row of heat exchange tubes 19. For a typical coil, this phenomenon occurs at an air velocity which produces a static pressure on the air side of about 0.22 inches $H_2O$. With the use of the present invention, the accumulation of water will not begin until the air flow is sufficient to produce a static air side pressure in excess of about 0.35 inches $H_2O$.

While this invention has been described in connection with a certain specific embodiment thereof, it is to be understood that this is by way of illustration and not by way of limitation; and the scope of the appended claims should be construed as broadly as the prior art will permit.

What is claimed is:

1. An evaporator coil assembly for use in an air conditioning system of the type in which the evaporator coil assembly is located within a plenum through which air to be conditioned is forced upwardly through said coil assembly comprising: an evaporator coil including a plurality of tube sections extending in at least two planes perpendicular to the direction of air flow; a plurality of substantially vertically arranged plate-like fins each lying in a plane parallel to the direction of air flow and being in heat exchange contact with substantially all the tube sections traversing said plane, each said fin having a lower edge providing V-shaped tapered portions with the apex thereof arranged at the lowermost condensate discharge point of each fin; a plurality of spaced parallel condensate-collecting troughs supported on said cabinet in said passage and extending substantially the length of said coil portions of said evaporator, said troughs underlying said V-shaped tapered portions of said fins and each trough having a width to underlie only the condensate discharge points of the adjacent fins to collect condensate gravitating from the fins while reducing interference with the flow of air through said passage to a minimum; and means defining an upper edge on each of said plate-like fins, said upper edge having a saw-tooth like configuration.

* * * * *